US005625338A

United States Patent [19]

Pildner et al.

[11] Patent Number: 5,625,338

[45] Date of Patent: Apr. 29, 1997

[54] WIRELESS ALARM SYSTEM

[75] Inventors: Reinhart K. Pildner, Brampton; James Parker, North York, both of Canada

[73] Assignee: Digital Security Controls Ltd., Downsview, Canada

[21] Appl. No.: 529,046

[22] Filed: Sep. 15, 1995

Related U.S. Application Data

[63] Continuation-in-part of Ser. No. 171,460, Dec. 16, 1993, abandoned.

[51] Int. Cl.[6] ..... G08B 1/08

[52] U.S. Cl. ..... 340/539; 340/225.69; 340/313; 340/314; 341/175; 341/176

[58] Field of Search ..... 340/539, 505, 340/517, 518, 531, 825.69, 825.72, 825.5, 313, 314; 341/173, 175, 176

[56] References Cited

U.S. PATENT DOCUMENTS 4,754,255 6/1988 Sanders et al. ..... 340/539

5,252,966 10/1993 Lambropoulos et al. ..... 340/125.69

*Primary Examiner*—Donnie L. Crosland

[57] ABSTRACT

A security system having a two way wireless keypad which operates in a particular manner for improved operation. The keypad processes information to effectively reduce communications between the control panel and the keypad. The keypad selectively activates and deactivates a transmitter and receiver arrangement for power conservation reasons. The system provides confirmation of communications between the keypad and the control panel to increase the reliability of the system.

5 Claims, 6 Drawing Sheets

WIRELESS ALARM SYSTEM

CROSS-REFERENCE TO RELATED APPLICATIONS

This application is a continuation-in-part of Ser. No. 08/171,460, filed Dec. 16, 1993 now abandoned.

FIELD OF THE INVENTION

The present invention relates to alarm systems and in particular to wireless alarm systems which rely on RF communication between various components.

BACKGROUND OF THE INVENTION

Security systems for protecting of property, in particular homes, have become quite common as well as the monitoring of such systems by a central monitoring service. Initially, these security systems were hard wired systems where the various sensors and data entry keypads were hard-wired to a control panel. The control panel processed all the information and based on this information, determined alarm conditions and preferably completed a telephone communication with a central monitoring service.

As the systems continued to develop, the sensors for detecting motion and/or the state of windows or doors, communicated with the control panel by a narrow band RF transmission and as such, were wireless. Most of these systems continued to have a keypad typically adjacent a particular entry point, which keypad was used by the owner to arm the security system and disarm it when he returned to the premises. The keypad was hard-wired to the control panel and basically functioned as a dumb terminal.

Some security systems have used a one-way narrow band RF keypad where each keypad entry is transmitted to the control panel using an RF transmitter. These keypads do not have a receiver and therefore only send information to the control panel as it is entered at the keypad. Such one-way systems have limited usefulness as they cannot provide confirmed information as to the status of the system and cannot allow the user to query the control panel for system information. In addition to facing limitations imposed by FCC and other broadcasting authorities on narrow band RF systems, excessive RF transmissions of such one-way systems can also cause control panel problems. The control panel can only receive one signal at a time and transmission of multiple signals can corrupt or block transmissions. Various arrangements have been used to reduce the impact of this problem. Some of the solutions included multiple signal transmissions at spaced time intervals designed to minimize the likelihood of conflict, however, this may unnecessarily increase the traffic. The prior art one-way keypads typically transmitted in the 300 MHz band, which must meet strict FCC regulations, which limit their effectiveness. There was also problems with expected battery life and there was no check on the integrity of the system, as the keypad was basically blind to the control panel and other components.

For these reasons, hard-wired keypads are most commonly used.

SUMMARY OF THE INVENTION

It is possible with the present invention to provide a security system in which the keypad is both a receiver and a transmitter and communicates with and receives communications from the control panel. The keypad is operable in an active mode and a sleep mode to allow conservation of power. In the sleep mode there is a timing arrangement which wakes the keypad at appropriate times to allow the keypad to check in with the control panel. This provides a check on the operating condition of the keypad. If a user presses a key at the keypad, the keypad changes from the sleep mode to the active mode and typically completes a certain exchange of information with the user to determine that the user is authorized and the exact state of the system.

The keypad, when placed in an active mode, powers the display screen by means of which information is communicated from the keypad to the user. The user inputs information by pressing various keys and the keypad in response thereto typically presents additional prompts, such as questions requiring a YES/NO selection. Preferably, the keypad, when initially activated, transmits a signal to the control panel and subsequently receives confirmation from the control panel that the initial communication was received. The predetermined prompts are preferably retained in a nonvolatile Read Only Memory.

According to a preferred aspect of the invention, the control panel, when initially contacted by the keypad, advises the keypad of any trouble conditions, alarm conditions or changes in zone conditions that may have been experienced by the system or otherwise advises the keypad of the status of the system.

The keypad has been specifically designed to include additional logic at the keypad whereby the number of transmissions between the keypad and the control panel can be reduced. The user and the keypad go through predetermined sequences and prompts to allow the user to advise the keypad of particular information and instructions and once this interaction has been completed, the keypad then communicates with the control panel. The control panel, upon receipt of the communication, transmits an acknowledgement signal. Receipt of the acknowledgement signal allows the keypad to then perform other steps or go to sleep mode. If no acknowledgement signal is received, the keypad retransmits. This approach places additional logic at the keypad and reduces the number of communications with the control panel while providing positive acknowledgement of received signals. Positive acknowledgement reduces the number of transmissions, reduces power requirements and provides improved reliability. Additional power savings and reliability are realized by using RF spread transmission techniques.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
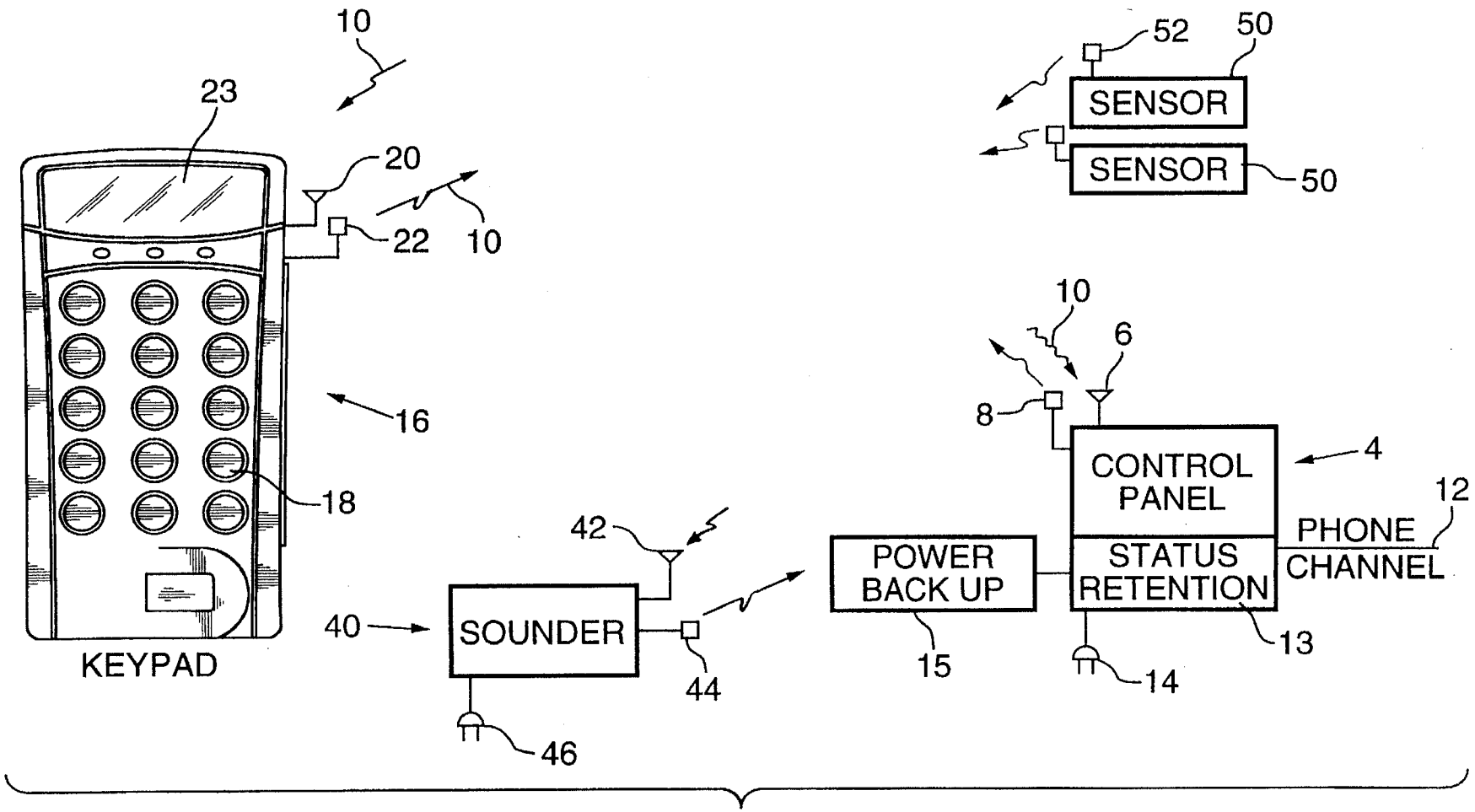
FIG. 1 is a schematic of the alarm system.

The security system 2 includes a control panel 4 which is basically the heart of the security system and previously included essentially all of the intelligence. The control panel has a receiver 6 as well as a transmitter 8 and as such, can receive RF signals from any of the components of the security system, namely the keypad 16, the sounder 40 or any of the sensors generally indicated as 50. The control panel is also connected to a telephone channel 12 by means of which it can contact a central monitoring service, should an alarm or trouble condition require reporting. The control panel 4 is also shown as having a ROM (read only memory) 13, an AC power connector 14 and a battery power backup generally indicated as 15. The nonvolatile ROM can be an Electrically Erasable Programmable Read Only Memory (EEPROM). The control panel is electrically connected to the AC power supply at a convenient point in the home and preferably at a protected position away from a point of entry. The control panel includes the required processing arrangement and logic for processing signals and communicating with the sounder and keypad. The term keypad is used broadly to include various entry pads having keys or other means for entering information.

Certain information is typically stored in the control panel in a ROM, however, there is a need of a small amount of Programmable Read Only Memory (PROM) for customized installation information. In some cases, particular labels are used for different zones in the protected area (i.e. upstairs hall, master bedroom, basement storage, etc.). By providing a small amount of PROM, unique zone labels can easily be changed or added.

The sensors 50 have their own transmitter 52 and therefore send signals to the control panel, either on a periodic basis to check in or when an alarm condition has been determined. The control panel typically knows the state of the system and therefore produces an alarm when a sensor senses an alarm condition and when the system has been armed or partially armed. The system is capable of recognizing different states (armed/not armed) for different sensors or zones. Often it is desired to maintain a certain security of a particular structure or device (for example a gun cabinet or a fire detector) or a particular zone (storage area that is infrequently used) on a continuous basis or in a particular manner. The present system satisfies these requirements. Each sensor, upon sensing an alarm condition, preferably transmits an alarm signal a predetermined number of times in accordance with transmission logic to reduce the likelihood of interference with other transmissions. Typically, these sensors can have a repeating transmission pattern which is coordinated with the transmission pattern of the other components, such that the probability of interference with transmissions of other sensors has been greatly reduced. These devices can retransmit the signal up to four times or, in some cases, eight times. This is satisfactory for the sensors, in that a receiver is not required and the effective life of the battery power supply of the sensor is quite long (i.e. typically several years).

The sounder 40 has its own receiver 42 and a transmitter 44. The control panel 4 sends signals to the sounder typically when an alarm condition (such as a fire) exists or when the user's attention or input is required. The sounder produces a tone signal when a person has instructed the system to be armed and a certain period of time is allowed to exit the premise, or when the person returns to the premises and has a certain time period to disarm the system by entering a proper authorizing code. During these transitional periods, often the sounder makes an intermittent sound to provide an audible signal for the user indicating the state of the system or the requirement for information input to the system. Therefore, the sounder is used in combination with the keypad to provide an audible signal (sounder) and a visual signal (display on keypad) to inform the user of the need to input information or complete certain steps. The sounder is typically connected by the electrical connector 46 to the AC power supply, but it also includes a power backup, generally indicated as 48.

The sounder 40 is a two-way wireless device and relies on the RF transmission from the sounder to confirm that a signal has been received. The control panel 4 can check on the sounder more frequently due to its important function to the system, and in its normal operation, the sounder is always capable of receiving a signal from the control panel. The two-way capability of the sounder is particularly appropriate where power interruptions occur as the power backup 48 will be used. During such interruptions, communication is maintained, however, to conserve power, a timing arrangement similar to the keypad check-in mode is used. Therefore, even during power outage, the system continues to function. For example, the system can still be armed or disarmed. This is important, as a user may be forced to leave the premises during a power outage and needs to arm the system.

In the system shown in FIG. 1, each of the components, namely the sounder, keypad and sensors, have their own identity code which forms part of their transmission signal. In this way, the control panel can receive the signal and identify that it has originated from one of the components of the system and the signal has not originated elsewhere, for example, from a component of a neighbor's system. Furthermore, the sounder cooperates with the control panel and signals are transmitted therebetween. Similarly, the keypad cooperates with the control panel and receives and transmits signals therebetween. It would be possible for the keypad and the sounder to communicate directly, but in the preferred embodiment, this option is not utilized.

There are several problems associated with a wireless keypad, generally shown as 16. Unfortunately, the keypad 16 requires substantial power when the receiver 20 is activated. This represents a significant energy drain and steps have been taken to minimize this requirement. Furthermore, the transmitter 22 when transmitting also requires a substantial amount of energy to have an effective range.

Figure 3:
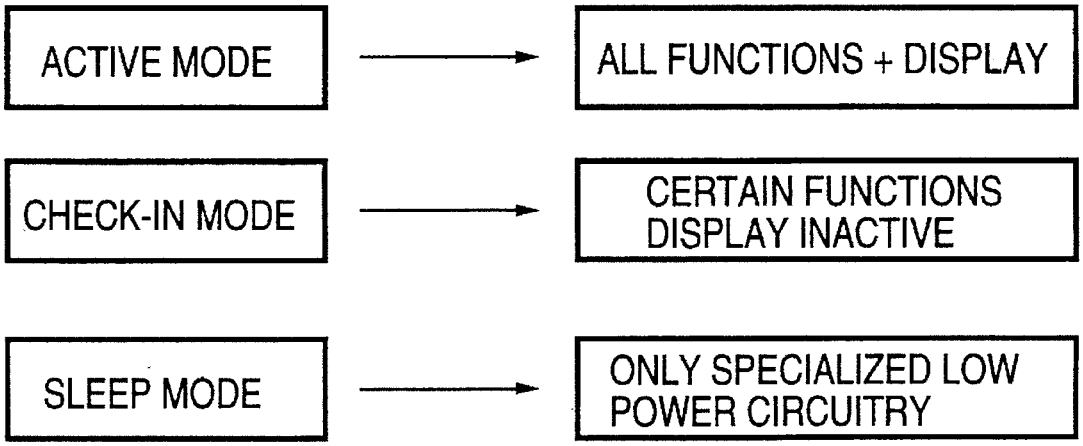
FIG. 3 is a block diagram showing various states of the keypad.

To save energy and extend the battery life, the keypad operates in one of three modes. In the first mode (active mode), the keypad is fully active and the screen 23 is powered. Specified messages or prompts (retained in nonvolatile memory of the keypad) will appear on the display screen (or an other suitable visual display). To force a keypad to the active mode, a user presses any of the keys preferably as the first key of an access code. This step kick starts the keypad and initiates a wake-up procedure, which causes the display screen to be activated and to display a request for the user to enter an access code. Once an access code has been entered, it is confirmed by logic either within the keypad or within the control panel via a wake-up communication between the keypad and the control panel. Confirmation of the access code by the control panel (via an acknowledgement signal) provides a higher degree of security, particularly if the keypad is portable as subsequently described. As part of this wake-up communication between the keypad and the control panel, the keypad is advised of the status of the system. Preferably, the keypad is coordinated with the control panel such that an RF signal, transmitted from the keypad and received by the control panel, is acknowledged by the control panel through an acknowledgement signal which is received by the keypad. If an acknowledgement signal is not timely received, the keypad is programmed to retransmit the signal. The signals transmitted between the keypad and control panel are indicated as 43 and 45 in FIG. 3.

Figure 5:
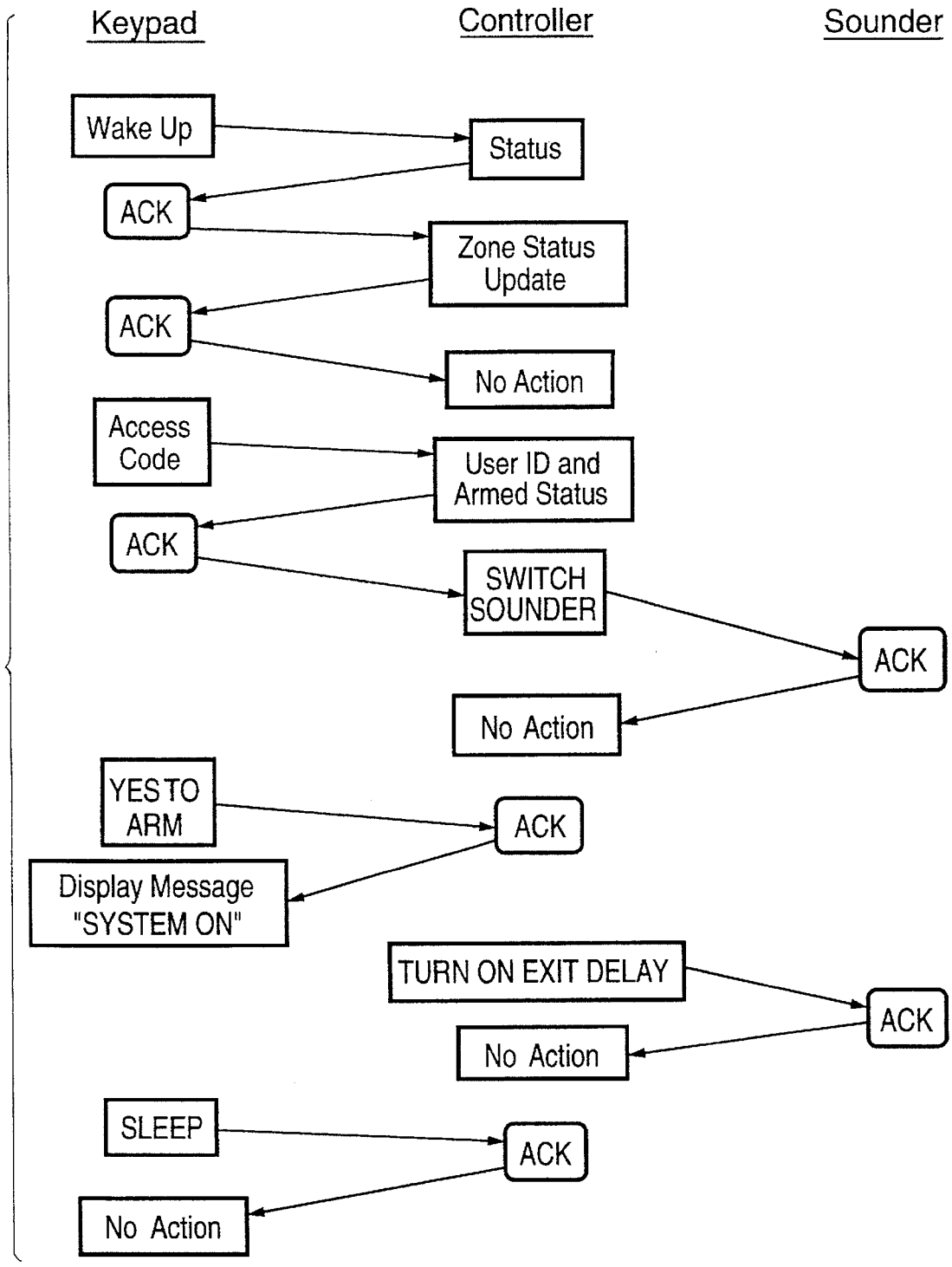
FIG. 5 is a schematic showing interaction of the keypad, controller and sounder during arming of the system.
Figure 6:
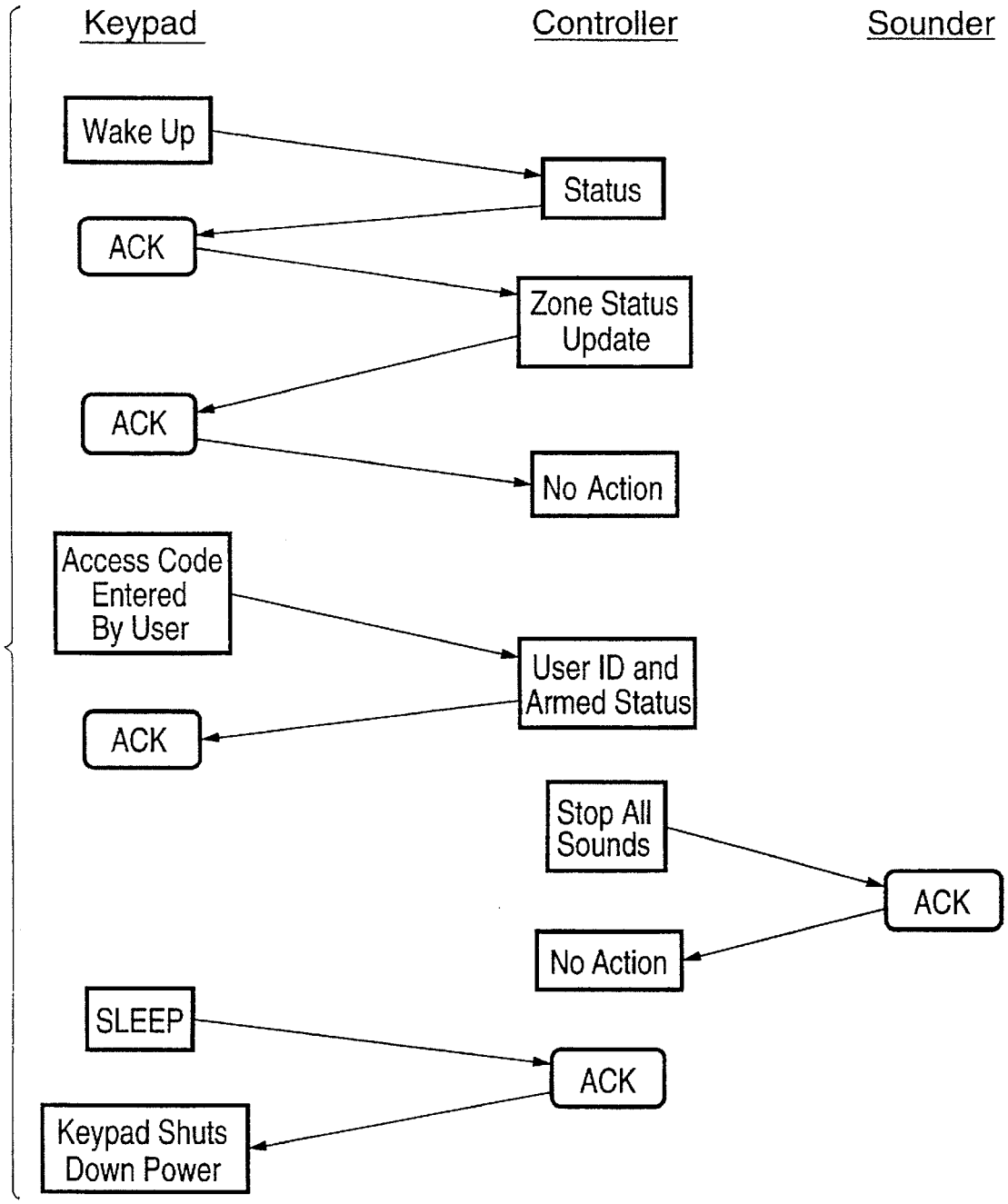
FIG. 6 is a schematic showing interaction of the keypad, controller and sounder during disarming of the system.
Figure 7:
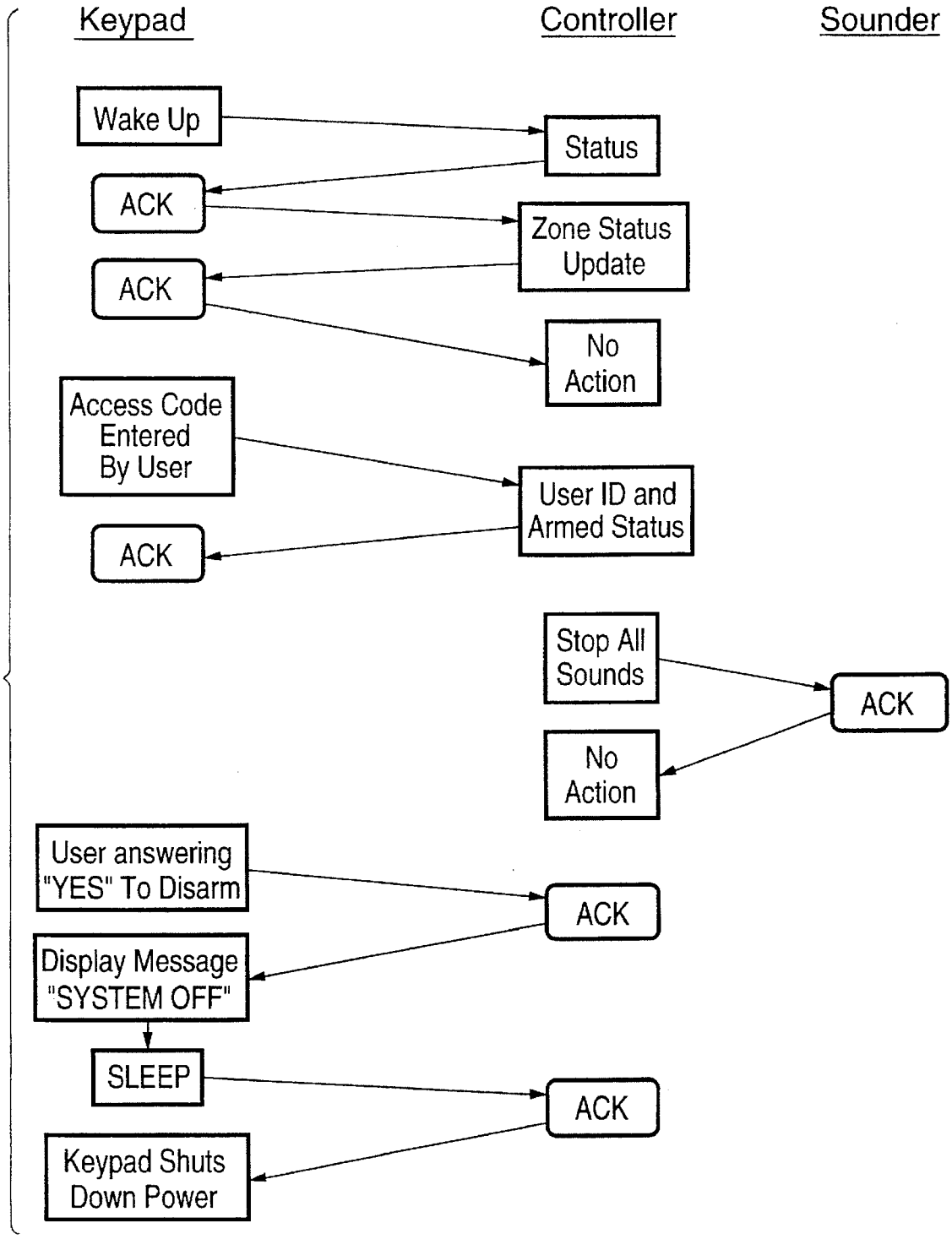
FIG. 7 is a schematic showing interaction of the keypad, controller and sounder to disarm the system when no alarms are present.

Within the active mode, several different functions are carried out. The most common function is the arming of the alarm system. During the arming function, the keypad is fully activated and the receiver is powered. The keypad and control panel are communicating in real time and changes to the system, such as locking a door, are reported to the keypad. In this function, the effective communication of information between the control panel and the keypad regarding the status of the system is desired. An arming sequence is shown in FIG. 5 where "ACK" is shortform for "acknowledgement signal". Disarming sequences are shown in FIGS. 6 and 7.

The active mode is also used for a status check of the overall system or to implement changes to the system. For example, in the disarm mode, the keypad first communicates with the control panel, by sending a signal indicating it has been activated, and after some communication, the access code is inputted in response to a prompt from the keypad, followed by the disarm signal. In this function, the receiver is only activated to receive the acknowledgement signals and therefore is selectively activated for limited periods when an acknowledgement signal is expected.

Another function within the active mode can be changes to the system, such as a change in time. The keypad leads the user through predetermined prompts to assemble the time, day, month, year information, and only after all of the information has been determined does the keypad communicate the information to the control panel and then selectively activate the receiver for receipt of an acknowledgement signal.

Figure 2:
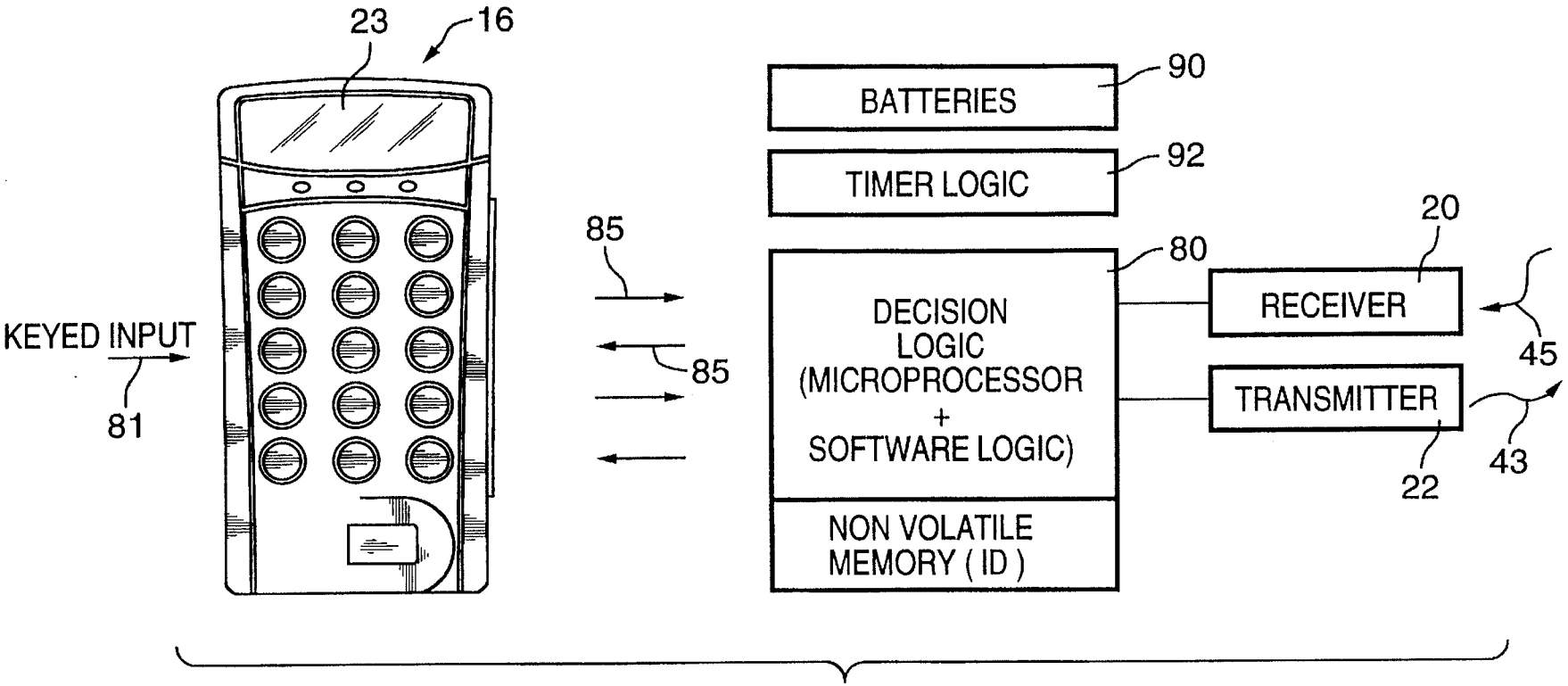
FIG. 2 is a schematic of various operations in the keypad.

It was found that the prior art practice of transmitting each key entry to the control panel with the control panel assembling and processing the keyed information was a very demanding burden on the power capability of the keypad and produced excessive transmissions. It was found that power could be conserved and a reduction in the number of transmissions achieved, by placing more logic and memory within the keypad and therefore allowing the keypad to effectively process user information and determine a particular state or function of the alarm system. The keypad then communicates this state, function or information to the control panel 4. In this way, as indicated in FIG. 2, a number of steps are taken to exchange information between the user who is inputting information by the entry of keys (this information is indicated as 81) to the decision logic of the keypad (which includes a microprocessor) indicated as 80, which then, in turn, requests further information of the user as indicated by the arrows 85.

The logic within the keypad is designed to simplify the information required to be inputted by the user and the various procedures have been embedded in decision logic within the keypad. The user provides input to the keypad of the general procedure and the keypad produces a series of prompts requiring YES/NO type input to determine the exact procedure and information. Access codes or change in zone labels does require a limited character string to be inputted, but much of the inputted information is by YES/NO input in response to prompts. This simplifies the demand on the required complexity of the keypad.

After completion of a suitable exchange of information, the keypad assembles the relevant information and transmits it to the control panel in a brief, efficient transmission. The use of prompts requiring a YES/NO input keeps the decision logic fairly simple and allows effective information to be accumulated prior to instructing the control panel. Once a decision or state has been determined, the keypad transmitter 22 is activated and sends out a signal indicated as 87. The receiver 20 is activated (i.e. a higher power requirement) in anticipation of receiving the acknowledgement signal 89 from the control panel. To conserve power, the receiver and transmitter are selectively powered during the active mode when signals are transmitted and/or the reception of a signal is anticipated or when real time system information is important (i.e. during the arming function). The keypad includes logic for determining whether an acknowledgement signal has been received within the expected time frame. If the signal is not received, then a further signal is transmitted to the control panel. In this way, the keypad does not always transmit four or eight signals for each piece of information, but actually receives an acknowledgement signal when the control panel has properly received the signal. Thus, the integrity and security of the system has been upgraded and unnecessary transmissions have been reduced and battery life conserved.

Figure 4:
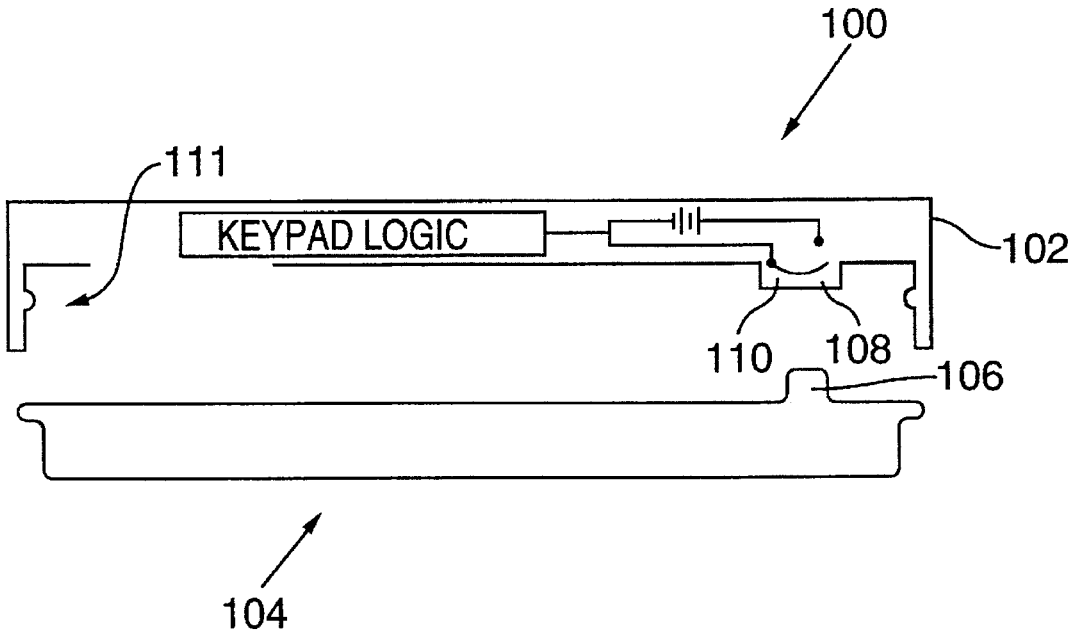
FIG. 4 is a schematic of a wireless keypad with a tamper switch.

The keypad also includes a battery power supply indicated as 90 and timer and supervisory logic indicated as 92. The screen 23, the decision logic indicated as 80, the receiver 20 and transmitter 22 can all be in an active mode, a sleep mode or a check-in mode as indicated in FIG. 4. In the active mode, the keypad gathers and assembles information and the display screen 23 is activated. The transmitter and receiver are activated during the arm function and selectively activated during other functions. This is a high power usage state, and therefore, if no information is being entered or required of the system, the keypad goes into a sleep mode to conserve power. This sleep mode shuts down the decision logic, the display screen and the receiver and transmitter. The timer and supervisory logic 92 is maintained, however, these are designed for very low power consumption. The timer logic wakes up the keypad or portions thereof at predetermined intervals to check in with the control panel. It is not necessary to power the display screen during this check in mode. The timer and supervisory logic 92 also serves to initiate a wake-up procedure for the keypad if one of the entry keys is pressed. Obviously, if there is a user using the keypad, the keypad assumes the active mode and this is detected by the actuation of a key.

Most microprocessors include a power saving mode or sleep mode, where some of the functions of the microprocessor are still active. Although this saves power, it is preferred to use a separate timer and supervisory logic 92 and to shut down the microprocessor entirely to reduce the power requirements.

Through the above-noted periodic communications from the keypad to the control panel, the panel can assess the integrity of the keypad as one component of the security system. If the keypad fails to check in, then the panel interprets that failure as an alarm condition to be reported to the monitoring service.

In an alternate embodiment of the inventive keypad, it would be possible for the keypad to be seized by the control panel to display information or request input from the user. This is achieved by having the keypad logic 80 waken receiver 20 for a brief period after transmission of the keypad's regular check-in signal to see if panel 4 is transmitting instructions or information to the keypad. In order to alert the user to the fact that the system wishes user input or to display information, the panel 4 may also cause sounder 40 to produce an appropriate sound.

The keypad also includes time out logic which forces the keypad to the sleep mode. For example, in the active mode, a delay of 30 seconds between key entries will cause the keypad to assume the sleep mode. The keypad will also assume the sleep mode following a series of information steps have been concluded after a short time period (5 seconds) if no further key entries are made.

It has been found that a two-way keypad, using this concept of transferring logic to the keypad for effective processing of information, allows the keypad to be powered by conventional and readily available batteries, eg. four 'AA' batteries, and although the expected life will vary, the average expected life would be measured in years. The ability of the keypad to fully assemble or process information as opposed to the mere transmission of each keystroke to the controller, has significantly improved expected battery life. Furthermore, the receiver and transmitter use an RF spread spectrum technique which provides additional power savings. The transmissions from the keypad are short bursts which provide effective range, acceptable power requirement, and a high degree of confidence. The spread spectrum signal uses the 900 MHz band and the FCC regulations for this band are less demanding and it has been determined more suitable for this security application. The spread spectrum technique allows faster lock on the signal and thus reduces the time period in which conflicting signals may be received. Furthermore, the spread spectrum technique provides higher security of transmissions as the transmission logic cannot be readily determined.

As part of the wake-up procedure between the keypad and the control panel, the control panel includes a signal indicating the status of the system. The system status is reported to the keypad in the first acknowledgement signal from the control panel. Thus, the acknowledgement signal is used to effectively communicate information as well as to confirm receipt of keypad instructions received by the control panel.

With this system, the receiver of the control panel is always active, and therefore, has fairly high power requirements. These power requirements are easily met, as it is plugged into the AC power source. Exact placement of the control panel can take this requirement into consideration without difficulty.

A modified wireless keypad arrangement 100 is shown in FIG. 4 which includes a separate keypad 102 which is adapted to connect with and be supported by the backplate 104. Backplate 104 can be mounted to a wall or other surface by any suitable means, such as by screws. The hand-held keypad may then be attached to the backplate and directly supported thereby. Mounting of the hand-held keypad 102 is accomplished by a suitable alignment of the backplate and the keypad, which also serves to align the stud 106 on the backplate with the receptacle 108 on the rear surface of the hand-held keypad. Engagement of the keypad 102 with the backplate 104 causes the stud 106 to close the switch 110, which is biased to the open position.

There are several advantages of this switch 110. For example, the switch 110 can be wired into the circuitry of the keypad 102 to render the keypad inoperative, unless it is mounted on the backplate. With this arrangement, the keypad 102 could first transmit a signal to the control panel indicating that it is no longer attached to the backplate and has now been removed. Depending upon the operation of the system, this can result in an alarm condition.

The release of the keypad 102 from the backplate 104 is also advantageously used during the initial installation of the system. The keypad 102 and backplate 104 are assembled as a unit at the time of manufacture, however, the keypad will require the insertion of batteries when it is being installed. This step requires separation of the keypad 102 from the backplate 104 to expose the battery chamber 111. Typically, during installation, the backplate 104 would be appropriately mounted near a point of entry and the keypad 102 would have its batteries installed and then be mounted on the backplate. This results in closing of the switch 110. It is possible with this arrangement to have the keypad 102 transmit a signal to the control panel 4 indicating that it is now being installed and the keypad and control panel commence a learning process. Along with the install mode signal, keypad 102 transmits a unique identification number associated therewith. This identification number forms part of all subsequent communications with the control panel. With this arrangement, each component of the system is enroled and only signals having the correct identification number are processed. In particular, the type of signals sent from the keypad 102 during this learning process are different than and can be distinguished from the typical signals sent when the keypad is active. Therefore, it is possible for the control panel 4 and the keypad 102 to communicate in an install mode, which has signals separate and distinct from the active mode. This avoids the possibility of a control panel being placed in the install mode and, in error, receiving and learning a signal from a different and unintended sensor or keypad, such as a neighbor's sensor or keypad. With this arrangement, the probability of both neighbouring systems being placed in the install mode at the same time is quite low and receipt of active signals does not effect the enrollment process.

The approach with the switch 110 can also apply to sensors which are provided with the removable backplate and circuitry. Again, a sensor, when being installed, can enter this install mode to thereby allow enrollment of the various components of the security system with the control panel in a specialized manner and reduce the possibility of incorrectly enroling a nonauthorized sensor.

It is also possible with this system to replace a sensor, if required, without recommissioning the security system. In this case, the user can cycle through a number of prompts until he is presented with the desired prompt, such as "Is a sensor to be replaced?". The user answers "yes" to the prompt and then is presented with further prompts to identify the particular sensor. Once the sensor is identified, the keypad advises the control panel. The control panel then ignores further signals from that particular sensor and instructs the keypad that the sensor can be removed. A new sensor can be added using the install mode previously described, but limited to that particular sensor or component.

It should be noted that the alarm system can continue to function in its normal manner while the one sensor is replaced. It is also noted that securement of a sensor or keypad to a mounted backplate which activates switch 110 ensures that the transmission signal received by the control panel in the install mode was transmitted from the actual location that the sensor or keypad will be located. Therefore, if there is a transmission problem associated with location, it should be recognized during the installation process.

As described with the keypad, the switch can also be used as a tamper switch to alert the control panel that a sensor has been removed. Typically, this results in an alarm signal which is appropriately processed by the control panel.

The wireless keypad of the present invention uses a spread spectrum technique in the 900 MHz band and provides a high degree of confidence in the reception and transmission of signals. Efficient transmissions, good transmission range, and increased security are realized using this technique for the two-way wireless keypad or two-way wireless sounder.

The wireless keypad greatly simplifies installation of the system as the feeding of wires from the control panel to the keypad is avoided. In addition, the range of suitable choices for locating the wireless keypad is greatly increased, making it more difficult for a thief to locate and perhaps sabotage. For instance, the wireless keypad could even be located on the back of a door. An installer locates the keypad at an appropriate location and then locates the control panel such that it can be plugged into an AC source and connected to the telephone system. The sounder is then suitably located adjacent an AC power source. The system can be checked for interference and to ensure that each of the components is effectively communicating with the control panel. The two-way wireless security system provides a higher degree of reliability, improved user interaction with the keypad and more efficient use of RF transmissions. This arrangement reduces the number of RF transmissions, improves the reliability of the system and provides integrity confirmation that the system components are operating satisfactorily.

In the preferred operating mode, the keypad communicates with the control panel, which, when necessary, activates the sounder. In the event the keypad cannot complete a communication to the control panel, a special signal can be sent to the sounder. The sounder, if appropriate, could be activated or attempt a communication to the control panel. In this way, the control panel can receive a signal that the keypad is for some reason blinded relative to the control panel. If the sounder cannot communicate with the control panel, the sounder could be activated, as the system is vulnerable. In some applications, the sounder can have additional logic to act as a limited backup control panel by maintaining whether the system is armed. If a sensor transmits an alarm signal which is monitored by the sounder but goes unanswered by the control panel, the sounder could take action on its own.

The two-way wireless keypad has been described in its normal role as being located at a point of exit. However, a two-way wireless keypad does not have to remain at a fixed location and can be portable and therefore can be carried or moved by the user, if desired. For example, at night, the user might prefer to arm the alarm system for night operation from his bedroom or disarm the system or change the system when he wakes up in the morning. This is easily carried out by taking the keypad with him.

If a portable keypad is desired, in some cases, it would still be desirable to have a second fixed location keypad to ensure that the system cannot be rendered nonfunctioning by the loss of the portable keypad.

It is also possible with this two-way wireless keypad to provide the user with a separate personal keypad which can be used to arm/disarm or vary the alarm system. This personal keypad would allow a user to disarm the system prior to entering the premises and reduce any stress or anxiety in having to rush to a fixed location to disarm the system within a predetermined time period. Therefore, the wireless keypad can be personalized and can operate from different locations within the premises or even exterior thereto. A personalized keypad can also advise the user of the status of the system prior to entering the premises. If an alarm has been activated or various trouble situations have been detected the user may prefer to contact authorities prior to entering the premises. In some cases, a silent alarm is used and the user can be alerted of the possibility of an intruder and avoid the possibility of a confrontation therewith or at least can be prepared for such a confrontation. The main point is information can be relayed without entering the premises. Such a system works best where an additional keypad or personal wireless two way control is used. If desired such a personal device can have limited features to make it more cost effective. Typically such a device will assume a non activated state when it is not in use or can have an on/off switch.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A wireless keypad for a security system in combination with a controller of the security system, said wireless keypad comprising a transmitter for transmitting RF signals to the controller, a receiver for receiving RF signals from the controller, means for selectively turning said transmitter on and off, input keys for allowing a user to input information, a display screen for displaying prompts to assist a user in inputting pertinent information, logic processing means for determining which prompts are displayed and in what order, said logic processing means accumulating information in response to multiple prompts to define an instruction signal for the controller and then communicating the instruction signal to the controller by transmitting an RF signal, after which said receiver is temporarily activated for receipt of an acknowledgement signal from the controller indicating that the information was received, and upon receipt, turning the receiver off; said keypad including standalone a battery power supply.

2. A wireless keypad as claimed in claim 1 wherein said battery power supply, during normal operation of said keypad, has a life of over one year.

3. A wireless keypad as claimed in claim 2 wherein said battery power supply is non-rechargeable.

4. A wireless keypad as claimed in claim 1 wherein said logic process means includes a very low power wake up circuit and said keypad is selectively shut down such that only said wake up circuit draws power while temporarily returning said keypad to an active mode from time to time for a period sufficient to check in with the controller.

5. A wireless keypad as claimed in claim 1 wherein said logic processing means, upon actuating any actuation key, places said keypad in an active mode.

* * * * *